US006622067B1

(12) United States Patent
Lovelace, II et al.

(10) Patent No.: US 6,622,067 B1
(45) Date of Patent: Sep. 16, 2003

(54) CONFIGURATION OF A REMOTE DATA COLLECTION AND COMMUNICATION SYSTEM

(75) Inventors: John Howard Lovelace, II, Erie, PA (US); Thomas George Cook, Fairview, PA (US); James E. Pander, Erie, PA (US)

(73) Assignee: General Electric Company, Schenectady, NY (US)

( * ) Notice: Subject to any disclaimer, the term of this patent is extended or adjusted under 35 U.S.C. 154(b) by 191 days.

(21) Appl. No.: 09/698,529

(22) Filed: Oct. 27, 2000

Related U.S. Application Data

(63) Continuation-in-part of application No. 09/620,003, filed on Jul. 20, 2000.

(60) Provisional application No. 60/162,294, filed on Oct. 28, 1999.

(51) Int. Cl.[7] ..... G08B 1/08

(52) U.S. Cl. ..... 701/19; 701/36; 340/539

(58) Field of Search ..... 701/79, 36, 99; 340/539, 825.49, 825.52, 825.36; 342/457, 357; 700/65

(56) References Cited

U.S. PATENT DOCUMENTS

| | | | | |
|---|---|---|---|---|
| 4,517,468 A | | 5/1985 | Kemper et al. | |
| 4,974,181 A | | 11/1990 | Sinderson et al. | |
| 5,513,107 A | | 4/1996 | Gormley | |
| 5,781,871 A | | 7/1998 | Mezger et al. | |
| 5,867,714 A | | 2/1999 | Todd et al. | |
| 5,956,664 A | * | 9/1999 | Bryan | 701/19 |
| 5,959,529 A | | 9/1999 | Kail, IV | |
| 6,430,481 B1 | * | 8/2002 | Lovelace, II et al. | 701/19 |

* cited by examiner

*Primary Examiner*—Richard M. Camby
(74) *Attorney, Agent, or Firm*—Carl A. Rowold; John L. DeAngelis, Jr.; Beusse Brownlee Bowdoin & Wolter, P.A.

(57) ABSTRACT

A method and apparatus for modifying configuration information used to control an on-board monitor located aboard a locomotive. Under the control of a remote monitoring and diagnostic center, the on-board monitor periodically collects information from the locomotive and transmits it to the remote monitoring and diagnostic center. When it is desired to change some aspect associated with the data collection process (including the period during which the data is collected, the types of data collected, etc.), it is necessary to change the configuration file that controls the on-board monitor. The configuration file is changed at the remote monitoring and diagnostic center and then transmitted to the on-board monitor.

11 Claims, 2 Drawing Sheets

CONFIGURATION OF A REMOTE DATA COLLECTION AND COMMUNICATION SYSTEM

This patent application is a continuation-in-part of U.S. patent application bearing application Ser. No. 09/620,003 filed on Jul. 20, 2000, which claims the benefit of U.S. provisional application 60/162,294 filed on Oct. 28, 1999.

BACKGROUND OF THE INVENTION

The present invention is directed in general to monitoring operational parameters and fault-related information of a vehicle, for example, a railroad locomotive, and more specifically, to a method and apparatus for remotely controlling and configuring the monitoring process.

Cost efficient vehicle operation, especially for a fleet of vehicles, requires minimization of vehicle down time, and especially avoidance of line-of-road or in-service failures. Failure of a major vehicle system can cause serious damage, require costly repairs, and introduce significant operational delays. When the vehicle is a railroad locomotive, a line-of-road failure is an especially costly event as it requires dispatching a replacement locomotive to pull the train, possibly rendering a track segment unusable until the disabled train is moved. Therefore, the health of the vehicle engine and its constituent sub-assemblies is of significant concern to the fleet operator.

One apparatus for minimizing vehicle down time., measures performance and fault-related operational parameters during vehicle operation. This information can provide timely and important indications of expected and actual failures. With timely and nearly continuous access to vehicle performance data, it is possible for repair experts to predict and/or prevent untimely failures. The on-board monitor collects, aggregates, and communicates performance and fault related data from an operating vehicle to a remote site, for example, to a remote monitoring and diagnostic center. The data is collected periodically or upon the occurrence of certain triggering events (i.e., anomalous conditions) or fault conditions that occur during operation. Generally, anomalous or fault data is brought to the attention of the vehicle operator directly by these vehicle systems, but typically the vehicle lacks the necessary hardware and software elements to diagnose the condition. It is therefore advantageous to utilize an on-board monitor to collect and aggregate the information and at the appropriate time send it to a remote monitoring and diagnostic service center. Upon receipt of the performance data at the remote site, data analysis tools operate on the data to identify the root cause of potential or actual faults. Experts in vehicle operation and maintenance also analyze the received data. Historical data patterns of anomalous data can be important clues to an accurate diagnosis and repair recommendation. The lessons learned from failure modes in a single vehicle can also be applied to similar vehicles in the fleet so that the necessary preventive maintenance can be performed before a line-of-service break down occurs. If the data analysis process identifies incipient problems, certain performance aspects of the vehicle can be derated to avoid further system degradation and farther limit violations of operational thresholds until the vehicle can undergo repair at a repair facility. Personnel at the remote monitoring and diagnostic center also develop review the operational data to generate repair recommendations for preventative maintenance or to correct faults.

BRIEF SUMMARY OF THE INVENTION

An on-board monitor aboard a vehicle monitors and collects data indicative of the locomotive operation from several locomotive control systems. This data is stored within the on-board monitor and downloaded to a remote monitoring and diagnostic center for analysis and the generation of repair recommendations. Generally, the downloads occur on a periodic basis, but certain fault events on the vehicle trigger an immediate download. The on-board monitor operates under control of one or more configuration files stored within it. Among other things, these files include the identity of the operational parameters to be collected and also the events that require an immediate download to the remote monitoring and diagnostic center. The remote monitoring and diagnostic center provides these configuration files and can modify the configuration files as required to change the operational characteristics of the on-board monitor. When the configuration files are changed at the remote monitoring and diagnostic service center, they are uploaded to the on-board monitor whenever a communications link is established between the on-board monitor and the remote monitoring and diagnostic center.

BRIEF DESCRIPTION OF THE DRAWINGS

The present invention can be more easily understood and the further advantages and uses thereof more readily apparent, when considered in view of the description of the preferred embodiments and the following figures, in which.

DETAILED DESCRIPTION OF THE PREFERRED EMBODIMENTS

Figure 1:
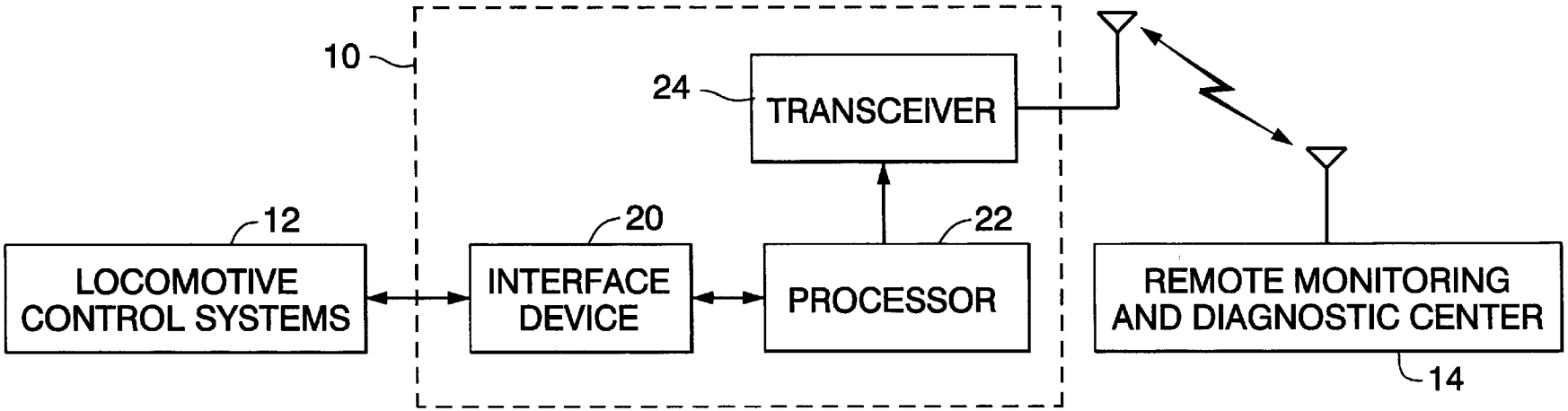
FIG. 1 is a block diagram of the essential elements of an on-board monitor that is configured according to the teachings of the present invention.

Before describing in detail the particular configuration apparatus and method in accordance with the present invention, it should be observed that the present invention resides primarily in a novel combination of processing steps and hardware related to a software configuration technique. Accordingly, these processing steps and hardware components have been represented by conventional processes and elements in the drawings, showing only those specific details that are pertinent to the present invention so as not to obscure the disclosure with structural details that will be readily apparent to those skilled in the art having the benefit of the description herein.

FIG. 1 illustrates the environment to which the present invention applies. A locomotive on-board monitor 10 is coupled to a plurality of locomotive control systems, depicted generally by reference character 12. These locomotive control systems can include: a locomotive controller, an excitation controller, an auxiliary equipment controller, and a propulsion system controller. The specific nature and function of the controllers are not germane to the present invention, except to the extent that the on-board monitor 10 monitors various parameters associated with these control systems. The data collected by the on-board monitor 10 provides important locomotive performance and status information, which is analyzed at a remote monitoring and diagnostic center 14 to identify active faults, predict incipient failures, and provide timely information about existing operating conditions. The data gathering process of the on-board monitor can be modified (either automatically by the system itself or upon command from the remote monitoring and diagnostic center 14) to further isolate or define the nature of the fault. For example, the data gathering process can be modified to collect additional operational parametric information or collect the information more frequently in response to the occurrence of a fault in the system or on command from personal at the remote monitoring and diagnostic center 14, who are attempting to diagnose a particular fault. Also, environmental conditions to which the locomotive is subject can serve as the basis for changing the operational data gathering process. For instance, while the locomotive is operating in summer weather conditions, the data gathering process can be configured to ignore faults and conditions that relate only to winter operation, e.g., faults associated with the vehicle cab heating system can be ignored.

The on-board monitor 10 functions as a data acquisition, signal conditioning, data processing, and logging and storing instrument that provides status information to the remote monitoring and diagnostic center 14 via a bi-directional communication path between the on-board monitor 10 and the remote, monitoring and diagnostic center 14. Certain parametric and fault-related information gathered by the on-board monitor 10 is collected and stored as raw data in raw data files. Other data collected is used to generate operational statistics and stored as statistical parameters, rather than stored as raw data. Both the raw data files and the statistical data files are downloaded to the remote monitoring and diagnostic center 14. Likewise, operational commands and reconfiguration commands are uploaded to the on-board monitor 10 from the remote monitoring and diagnostic center 14.

At the remote monitoring and diagnostic service center 14, the data is analyzed by software tools and locomotive repair experts. In response to this analysis, the on-board monitor 10 may require reconfiguration to modify some aspect of its operation. To accomplish this, a reconfiguration signal is sent to the on-board monitor 10 from the remote monitoring and diagnostic center 14. Such a signal might, for example, command the on-board monitor 10 to increase or decrease the frequency at which it collects certain parametric information or collect additional parametric data concerning the performance of the locomotive.

Certain aspects of the data collection processes carried out by the on-board monitor 10 are based on specific trigger equations and logic statements that operate on vehicle operational parametric values. Each trigger equation is associated with an instruction that modifies the data collection process. When a trigger equation is satisfied, e.g., the equation result exceeds a predetermined threshold, the on-board monitor 10 modifies the data collection process in accordance with the instruction. For example, the instruction may command the on-board monitor 10 to collect different operational parametric values than had been collected in the past or to collect the same information but on a more frequent basis. Thus, each trigger equation has associated with it a list of the parametric operational information to be collected and also a statement of the equation defining when to collect that information. An exemplary trigger equation is: collect cooling water temperature if ambient temperature is less than 30° F. and locomotive is being operated at throttle position eight. The configuration scheme of the present invention allows remote modification of both the triggering statement and the information to be collected as associated with the triggering statement. As mentioned above, these modifications are accomplished by way of the configuration file under control of the remote monitoring and diagnostic center 14.

The on-board monitor 10 comprises an interface device 20, a processor 22, and a transceiver 24. The interface device 20 communicates bi-directionally with the various locomotive control systems 12 and the processor 22. The interface device 20 performs typical data acquisition and conditioning processes, as is well known to those skilled in the art. The processor 22 controls operation of the on-board monitor 10 including especially control over the nature and frequency at which data is collected from the locomotive control systems 12. The transceiver 24, under control of the processor 22, communicates with a transmitter/receiver device in the remote monitoring and diagnostic center 14. As is known to those skilled in the art, there are a number of appropriate communication schemes for implementing this link. Included among these schemes are: cellular telephone, satellite phone, or point-to-point microwave. Since the locomotive spends considerable time in transit hauling either freight or passengers, sometimes in remote regions, it has been observed that a satellite-based link provides the most reliable communications medium between the locomotive and the remote monitoring and diagnostic center 14.

The on-board monitor 10 includes a call-home feature that automatically initiates a call back to the remote monitoring and diagnostic center 14. The call-home feature can be configured from the remote monitoring and diagnostic center 14 such that the call home is made in conjunction with certain anomalous or fault situations that occur either within the on-board monitor 10 or within one or more of the locomotive control systems 12. For instance, when the on-board monitor 10 senses the occurrence of certain predetermined faults in the locomotive, a call-home is made immediately. Note that for all but the most serious faults or those that disable it, the locomotive remains in service during the fault condition. Further, not all faults and anomalies cause an immediate call-home.

One such fault that creates an immediate call-home involves the operational log of the on-board monitor 10. The on-board monitor 10 maintains the operational log and records the occurrence of various events and anomalies related to the locomotive control systems 12 and the on-board monitor itself. The operational log is downloaded to the remote monitoring and diagnostic center 14 on a periodic basis. In the event the operational log fills the memory space allocated to it, a call-home is made immediately and automatically to the remote monitoring and diagnostic center 14. After the call is set up, the on-board monitor 10 downloads to the remote monitoring and diagnostic center 14 a unique event code indicating that the operational log is full. The call is then terminated and the remote monitoring and diagnostic center 14 calls the on-board monitor 10, instructing the on-board monitor 10 to download the operational log. If the operational log is not downloaded, old entries in the operational log would be written over as new entries are created, and the information in the operational log would be lost. Finally, the remote monitoring and diagnostic center 14 calls the on-board monitor 10 on a predetermined schedule (in one embodiment three times per day) to download data collected.

To initiate a call-home, the processor 22 commands the transceiver 24 to establish a communications link with the remote monitoring and diagnostic center 14. As discussed above, this link is usually satellite based. When the link is closed, the on-board monitor 10 transmits its unique road number and a code identifying the event that precipitated the call home. For example, one such event code notifies the remote monitoring and diagnostic center 14 that the operational log of the on-board monitor 10 is full. Other event codes relate to the occurrence of certain faults or anomalous conditions on board the locomotive. The call-home then terminates and the remote monitoring and diagnostic center 14 calls the locomotive using a unique communications system access number associated with calling locomotive. This number is retrieved by using the locomotive road number as an index into a cross reference table to retrieve the unique communications access number (or telephone number). In one embodiment, the telephone number allows access to the on-board communications system via a satellite-based link. In another embodiment, the unique communications access number of the calling locomotive: can be determined at the remote monitoring and diagnostic center 14 by the use of a caller identification process, which is well known in the art, in lieu of using the cross-reference table.

The remote monitoring and diagnostic center 14 then calls the locomotive. Once the communications path is established, data related to the specified event number is downloaded from the on-board monitor 10 to the remote monitoring and diagnostic center 14. As discussed above, this information is analyzed at the remote monitoring and diagnostic center 14 for the purpose of creating a recommendation as to certain repairs that should be performed on the locomotive. The remote monitoring and diagnostic center 14 also calls the on-board monitor 10 on a predetermined time schedule to download the raw data files and statistical data files containing information operational parametric information. In one embodiment, three calls to the on-board monitor are made in each day.

The on-board monitor 10 includes a plurality of configurable files that define its operation. The following information is included in these configuration files: the operational parameters to collect from the locomotive control systems 12 (as set forth in the global definition file), the conditions under which certain parameters are to be collected (i.e., data collection triggers), the conditions under which the on-board monitor 10 should contact the remote monitoring and diagnostic center 14 (i.e., call-home faults or anomalies), and certain communication and security information necessary for establishing the communication link. The status of the on-board monitor operations log, discussed above, is included within the third configuration file mentioned above.

The communications and security information file includes the telephone number (or other communications system access number) of the remote monitoring and diagnostic center 14, an authorization password, and the user name to be used when the on-board monitor 10 contacts the remote monitoring and diagnostic center 14. Another configuration file is referred to as the remote monitoring and diagnostic center start-up file. This file includes certain timing information for the calls home initiated by the on-board monitor 10. In particular, if the on-board monitor 10 cannot set up the call, information in this file sets forth the number of times it should attempt to call home and the wait period between call attempts. The file also provides alternative telephone numbers for calling the remote monitoring and diagnostic center 14. The start-up file also contains a list of the software version numbers for the operating software of the various locomotive controllers. The life statistics file contains certain operational information, for instance, the amount of time the locomotive was in notch one, the total time spent in the dynamic braking mode, etc. The custom data file identifies the trigger events and stores the raw data to be returned when one of those triggering events occurs. The signal strength file stores signal strength information, including the locomotive location (as determined by a global positioning system of the on-board monitor 10) and the satellite signal strength at that location. Techniques for determining the signal strength of a received signal are well known in the art.

At the remote monitoring and diagnostic center 14, software tools and locomotive repair experts monitor the data received from the on-board monitors installed on locomotives operating in the field. Analysis of this information may reveal a change in certain operational parameters or the occurrence of certain anomalous or fault events that suggest the collection of data on a more frequent basis so that a more complete understanding of the nature of the event can be ascertained. Also, changes associated with the operational environment of the locomotive may require the collection of new or different data. For instance, if the locomotive moves into high altitude service (i.e., a lower ambient temperature) for an extended period of time or if the average outside temperature turns colder due to seasonal changes, then more temperature-sensitive operational parameters may be collected or the collection of such data may have to occur more frequently.

Once the remote monitoring and diagnostic center 14 is aware of an operation problem aboard the locomotive, repetitive calls home due to this known problem are not necessary and therefore the on-board monitor can be reconfigured so that these calls home are avoided. If a determination is made at the remote monitoring and diagnostic center 14 to change some operational or data-collection instruction of the on-board monitor 10, the configuration file related to that change for the specific locomotive is modified. The modified configuration file is stored at the remote monitoring and diagnostic center 14 until the next call between the locomotive and the remote monitoring and diagnostic center, whether that call is due to a scheduled daily download or due to a fault condition.

Figure 2:
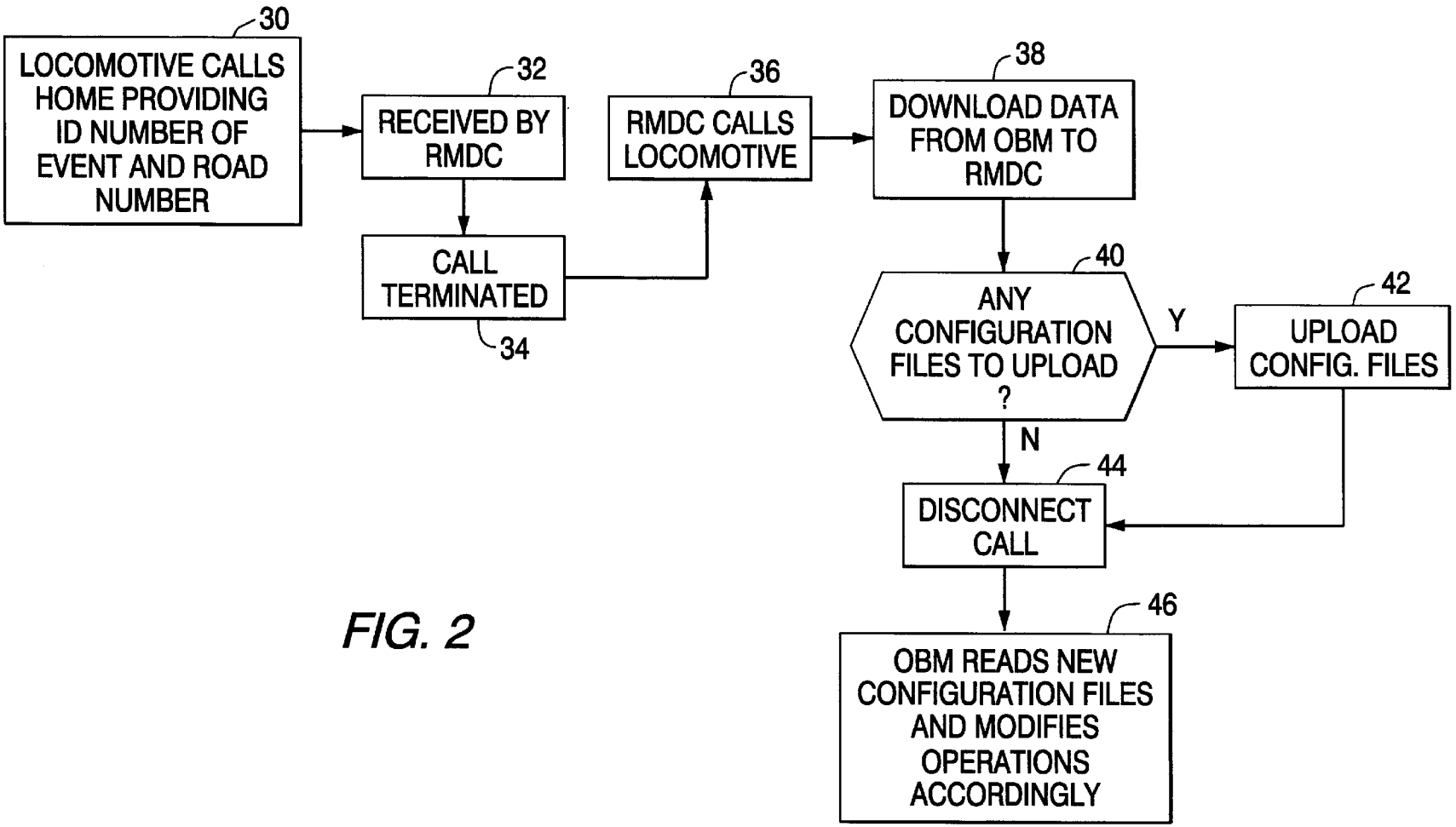
FIG. 2 is a flow chart illustrating operation of the configuration technique associated with the present invention.

FIG. 2 illustrates the process of downloading new configuration files to the on-board monitor 10. At a step 30, the locomotive on-board monitor calls home and provides an identification number for the event that precipitated the call-home, the road number of the calling locomotive, an authorization password (to gain access to the remote monitoring and diagnostic center 14) and its user name. The call is received at the monitoring and diagnostic center 14 at a step 32. At a step 34 the call is terminated. The remote monitoring and diagnostic center 14 calls the locomotive at a step 36. At a step 38 information collected by the on-board monitor 10, as discussed above, is downloaded to the remote monitoring and diagnostic center 14. At a decision step 40 the executing software at the remote-monitoring and diagnostic center 14 determines whether there are any new configuration files to upload to the locomotive on-board monitor 10. In response to the decision step 40, new configuration files are uploaded at a step 42. After loading the new configuration file, processing proceeds to a step 44 where the call is terminated. If there are no new configuration files to upload, processing moves directly from the decision step 38 to the step 44. At a step 46, the on-board monitor 10 reads the new configuration files and modifies its operations accordingly.

As discussed above, under normal conditions, the remote monitoring and diagnostic center 14 periodically initiates a call to the locomotive. Under these circumstances, the process of uploading new configuration files begins at the step 36 of FIG. 2.

Continuing with the heuristic example involving the operational log discussed above, the on-board monitor 10 calls home, identifying itself by a locomotive road number and provides an event number that represents the fault condition: operational log is full. Upon review of the operational log entries, a locomotive expert at the remote monitoring and diagnostic center 14 determines that the on-board monitor 10 is unable to communicate with one of the locomotive control systems. Each time the on-board monitor 10 attempts to read data from that control system, an entry is 10 generated in the operational log stating that the data download was unsuccessful. This entry is generated each time the on-board monitor 10 attempts to download data from the errant control system. If these download attempts are made at a high frequency (for example, once a minute) the operational log will quickly fill to capacity. As discussed above, a full operational log is an event for which the on-board monitor 10 has been configured to immediately call home. Once the locomotive expert at the remote monitoring and diagnostic center 14 understands the nature of this problem and the reason why this particular on-board monitor 10 is calling home frequently, the expert can reconfigure the on-board monitor 10 to terminate the calls home for this fault condition. This is accomplished by modifying the file to define the "operations log full" event as one that should not generate a call-home. In accord with the present invention, this reconfiguration file information will be sent to the on-board monitor 10 as discussed herein. After reconfiguration, the on-board monitor 10 will continue to note in the operational log its inability to communicate with the control systems, but when the operational log reaches its capacity, a call-home will not be initiated. At the remote monitoring and diagnostic center 14, in response to this situation, the locomotive repair expert will arrange for repair of the locomotive to correct this problem when the locomotive next arrives at a repair facility. Alternatively, the expert may request that a repair technician collect additional information from the locomotive concerning this problem, so that a repair recommendation can later be formulated.

In another embodiment of the present invention, data is collected from a fleet of locomotives, each having an on-board monitor 10. The fleet can include all locomotives owned and/or operated by a given railroad or all locomotives manufactured by a specific manufacturer, for example. The locomotives can be further segregated based on specific classes, wherein all the locomotives in a class have similar functional and structural attributes. In any case, the data collected at the remote monitoring and diagnostic center 14 is analyzed to identify operational problems or anomalous operating conditions. As discussed above, the analysis is undertaken with regard to a specific locomotive, but the data can also be aggregated to identify problems fleet-wide or among locomotives of a specific class. It may be determined that a fault or potential fault observed in a particular locomotive has a high occurrence probability in other locomotives of the same class or in all locomotives of the fleet. In such a case, the configuration files for all class or fleet locomotives may require modification to collect additional data related to the fault or potential problem.

In the event the analysis reveals a fleet-wide or class-specific fault, potential fault, or other problem, the remote monitoring and diagnostic center 14 modifies the configuration file associated with the affected locomotives. Depending upon the extent of the problem, configuration file modifications may involve all locomotives in the fleet or all locomotives of a specific class. After modifying the configuration file, the remote monitoring and diagnostic service center 14 broadcasts the new configuration file to all affected locomotives. To effectuate this process, the remote monitoring and diagnostic center 14 identifies each locomotive within the affected class or fleet by the locomotive road number or other unique identifier. A database at the remote monitoring and diagnostic service center 14 includes a table of telephone number addresses (or another identifier by which a communications channel can be established with a specific locomotive) for each locomotive. The locomotive road number serves as an index into that table to determine the communications identifier for each affected locomotive. The remote monitoring and diagnostic service center 14 then establishes a communications link with each affected locomotive individually or all affected locomotives simultaneously. During this call, the revised configuration file is uploaded to the locomotive. Upon receipt of the new configuration file, or shortly thereafter, each locomotive acknowledges receipt by way of an acknowledgement message downloaded to the remote monitoring and diagnostic service center 14. Operational data cannot be sent from a reconfigured locomotive until the acknowledgement message is received.

Although the present invention has been described with respect to retrieving operational and fault information from a locomotive, the teachings of the invention are applicable to any mobile asset, including an on-board monitor for measuring operational parameters and communicating the results to a remote monitoring and diagnostic center. In particular, these teachings can be applied with equal force to buses, trucks, off-road vehicles, or airplanes.

While the invention has been described with reference to a preferred embodiment, it will be understood by those skilled in the art that various changes may be made and equivalent elements may be substituted for elements thereof, without departing from the scope of the invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but rather that the invention includes all embodiments falling within the scope of the appended claims.

What is claimed is:

1. A method for identifying incipient failures in a fleet of railroad locomotives, each having a plurality of operational systems controllably monitored by an on-board monitor for collecting operational and fault-related data from the locomotive based on a first set of configuration information in the monitor supplied from a remote monitoring and diagnostic center, wherein the on-board monitor and the remote monitoring and diagnostic center are in selectable communication for transfer of operational and fault-related data and configuration information therebetween, the method comprising:

(a) determining the on-board monitor configuration information at the remote monitoring and diagnostic center, (b) receiving a unique identification signal from the on-board monitor associated with a predetermined locomotive for which a determination of incipient failures is to be made at the remote monitoring and diagnostic center;

(c) establishing a communications link between said on-board monitor for the locomotive and the remote monitoring and diagnostic center;

(d) at the remote monitoring and diagnostic center, determining if the use of a second set of configuration information at the on-board monitor would yield other operational and fault-related data that would be of value in identifying an incipient failure; and (e) in response to the step (d), uploading said second set of configuration information to the on-board monitor from the remote monitoring and diagnostic center to direct the on-board monitor of the desired locomotive to collect the desired operational and fault-related data.

2. The method of claim 1 further comprising, in response to the step (d), if the configuration information has not been modified, downloading operational information from the on-board monitor to the remote monitoring and diagnostic center.

3. The method of claim 1 wherein the configuration file modification occurs in response to changes in the operation of the mobile asset.

4. The method of claim 3 wherein the configuration file modification commands the on-board monitor to increase the frequency at which identified operational information is collected.

5. The method of claim 3 wherein the configuration file modification commands the on-board monitor to collect operational information not previously collected.

6. The method of claim 1 wherein the mobile assets are segregated into classes, wherein the mobile assets in a class share similar characteristics, further comprising a step (f) determining whether the on-board monitor configuration information must be modified for all mobile assets in a class; and (g) in response to step (f), uploading the most recent configuration information to all mobile assets in the class.

7. The method of claim 6 wherein the on-board monitor configuration information is uploaded by simultaneous broadcast to all mobile assets of the class.

8. The method of claim 6 wherein the on-board monitor configuration information is uploaded serially to each mobile asset of the class.

9. The method of claim 1 wherein the step (c) occurs in response to a change in the environment in which the mobile asset is operating.

10. The method of claim 1 wherein the mobile asset is a railroad locomotive.

11. The method of claim 1 further comprising a step (f) providing an acknowledgement from the mobile asset to the remote monitoring and diagnostic center confirming receipt of the modified configuration file.

* * * * *